US011760603B2

(12) United States Patent
Cortes Rodriguez

(10) Patent No.: US 11,760,603 B2
(45) Date of Patent: Sep. 19, 2023

(54) DETACHABLE PANEL FOR AN ELEVATOR PANEL ASSEMBLY

(71) Applicant: Otis Elevator Company, Farmington, CT (US)

(72) Inventor: Juan Cortes Rodriguez, Madrid (ES)

(73) Assignee: OTIS ELEVATOR COMPANY, Farmington, CT (US)

( * ) Notice: Subject to any disclaimer, the term of this patent is extended or adjusted under 35 U.S.C. 154(b) by 431 days.

(21) Appl. No.: 16/885,943

(22) Filed: May 28, 2020

(65) Prior Publication Data

US 2020/0385236 A1 Dec. 10, 2020

(30) Foreign Application Priority Data

Jun. 5, 2019 (EP) ..... 19382460

(51) Int. Cl.
*B66B 11/02* (2006.01)
*B66B 1/46* (2006.01)
*B66B 1/50* (2006.01)

(52) U.S. Cl.
CPC ..... *B66B 1/466* (2013.01); *B66B 1/50* (2013.01); *B66B 11/0253* (2013.01)

(58) Field of Classification Search
CPC . B66B 11/02; B66B 11/0226; B66B 11/0246; B66B 11/0253
See application file for complete search history.

(56) References Cited

U.S. PATENT DOCUMENTS 4,692,075 A 9/1987 Metz
6,739,432 B2 5/2004 Elsener
8,316,998 B2 11/2012 Henseler
9,745,172 B2 8/2017 Gebhardt et al.
10,227,213 B2 3/2019 Fauconnet et al.
10,252,887 B2 4/2019 Fauconnet et al.
2017/0144862 A1 5/2017 Fernandez et al.
2018/0105395 A1 4/2018 Cortes
(Continued)

FOREIGN PATENT DOCUMENTS

CN 2742644 Y 11/2005
CN 1283542 C 11/2006
CN 203112264 U 8/2013
(Continued)

OTHER PUBLICATIONS

European Search Report for application 19382460.4, dated Jan. 10, 2020, 44 pages.

(Continued)

*Primary Examiner* — Christopher Uhlir
(74) *Attorney, Agent, or Firm* — CANTOR COLBURN LLP

(57) ABSTRACT

An elevator panel assembly comprises a detachable panel (4), for covering a front surface of an elevator car panel (2*b*), and a separation member (7). The separation member (7) comprises a head portion (7*a*) received against a back surface of the detachable panel (4). The detachable panel (4) is magnetically attachable to the elevator car panel (2*b*) and comprises a through hole (9) which is smaller than the head portion (7*a*) of the separation member (7) and arranged to sit directly over the head portion (7*a*). The separation member (7) is configured so that a tool inserted through the through hole (9) engages with the head portion to apply a mechanical force, causing the head portion (7*a*) to push against the back surface of the detachable panel (4).

15 Claims, 6 Drawing Sheets

(56) References Cited

U.S. PATENT DOCUMENTS

| | | | |
|---|---|---|---|
| 2018/0208437 | A1 | 7/2018 | Durand et al. |
| 2018/0222723 | A1 | 8/2018 | Gressien et al. |

FOREIGN PATENT DOCUMENTS

| | | | |
|---|---|---|---|
| CN | 203411188 | U | 1/2014 |
| CN | 105584919 | A | 5/2016 |
| CN | 205207366 | U | 5/2016 |
| CN | 107792754 | A | 3/2018 |
| EP | 1031528 | B1 | 6/2003 |
| EP | 2114810 | B1 | 1/2011 |
| EP | 2190770 | B1 | 11/2011 |
| EP | 2877419 | B1 | 7/2016 |
| WO | 2018099939 | A2 | 6/2018 |

OTHER PUBLICATIONS

Chinese Office action for Application No. 201911394257.9; dated Oct. 26, 2022; 8 Pages.

DETACHABLE PANEL FOR AN ELEVATOR PANEL ASSEMBLY

FOREIGN PRIORITY

This application claims priority to European Patent Application No. 19382460.4, filed Jun. 5, 2019, and all the benefits accruing therefrom under 35 U.S.C. § 119, the contents of which in its entirety are herein incorporated by reference.

TECHNICAL FIELD

This disclosure relates to an elevator panel assembly including a detachable outer panel for covering a front surface of an elevator car panel.

BACKGROUND

It is known in the art to fix decorative panels over interior elevator car panels, to improve the appearance of the interior of the elevator car. In particular, it is known to permanently fix these decorative panels to the elevator car panels using screws or a clip mechanism.

It is also known in the art for parts of elevator car panels, also referred to as car walls, to be removable to allow maintenance access.

SUMMARY

According to a first aspect of this disclosure there is provided an elevator panel assembly, comprising: a detachable panel for covering a front surface of an elevator car panel, wherein the detachable panel is magnetically attachable to the elevator car panel; a separation member comprising a head portion received against a back surface of the detachable panel; wherein the detachable panel comprises a through hole which is smaller than the head portion of the separation member and arranged to sit directly over the head portion; and wherein the separation member is configured so that a tool inserted through the through hole engages with the head portion to apply a mechanical force, causing the head portion to push against the back surface of the detachable panel.

By providing a separation member, located behind a smaller through hole, the present disclosure allows a detachable panel to be fitted over an elevator car panel easily, and to be easily removable by an authorised maintenance person without being easily removable by a general passenger and whilst still having a neat outer appearance. In use, the force provided by the head portion pushing against the back surface of the detachable panel is sufficient to create a separation between the detachable panel and an elevator car panel. A maintenance person can then insert a tool or their fingertips into this separation to provide a force sufficient to overcome the magnetic attraction between the detachable panel and the elevator car panel, and remove the detachable panel from the elevator car panel.

The skilled person would understand the term "smaller" to refer to the dimension of the head portion in the plane of the detachable panel. For example, where the head portion is substantially round, as is the through hole, the diameter of the through hole is smaller than the diameter of the head portion of the separation member. As a result, although the head portion is aligned so that the through hole sits above the head portion, the head portion of the separation member cannot pass through the through hole due to its size. This results in an area of the detachable panel, surrounding the through hole, to which the separation member applies force when it is engaged with a tool. The term smaller does not refer, in this case, to the relative depth of the head portion compared to the through hole.

According to a second aspect of this disclosure, there is provided a method of detaching a detachable panel from a front surface of an elevator car panel to which a back surface of the detachable panel is magnetically attached, wherein a separation member comprising a head portion is received against the back surface of the detachable panel and the detachable panel comprises a through hole which is smaller than the head portion of the separation member and arranged to sit directly over the head portion, the method comprising: inserting a tool through the through hole in the detachable panel; and engaging the tool with the head portion of the separation member to apply a mechanical force, causing the head portion to push against the back surface of the detachable panel and thereby create a separation from the front surface of the elevator car panel.

In some examples, the method further comprises using the separation to apply a force sufficient to overcome the magnetic attraction between the elevator car panel and the detachable panel and removing the detachable panel.

In some examples the back surface of the detachable panel further comprises a recessed portion, surrounding the through hole and sized to contain the head portion of the separation member. This advantageously accommodates the head portion of the separation member, so that, when the detachable panel is fitted over an elevator car panel, the detachable panel can sit neatly flush against the elevator car panel.

In some examples, in addition or alternatively, the detachable panel is a decorative panel. This advantageously allows an elevator purchaser to make a choice of a panel, having an appearance which they find appealing. Although decorative panels are known which can be permanently fixed onto existing elevator car panels, the present disclosure provides a decorative panel which can be installed in a location in which frequent removal of the decorative panel is desirable or required, for example where the decorative panel is to be installed over a hinged panel, and where the decorative panel interferes with the opening of the hinged panel.

In some examples, in addition or alternatively, the detachable panel comprises at least one magnetic element permanently attached to the back surface of the detachable panel. This advantageously allows a simple means of magnetically attaching the detachable panel to an elevator car panel, which generally is constructed of, or contains, a ferromagnetic material.

In some examples, in addition or alternatively, the detachable panel comprises four magnetic elements, arranged towards the four corners of the back surface of the detachable panel. This advantageously provides for a strong fixing of the detachable panel so that it will not detach unintentionally, whilst also being attached with sufficiently low force that a separation can be created using the separation member.

In some examples, in addition or alternatively, the through hole is arranged close to the magnetic element(s). This results in the separation force produced by the separation member being applied close to the magnetic force which is holding the detachable against the elevator car panel. This allows the force provided by the separation member to more effectively separate the detachable panel from the elevator car panel. In the case of a panel including more than one magnetic element, and more than one through hole, one, some, or all of the through holes may be arranged close to a magnetic element. Each through hole may be arranged close to a different magnetic element, or more than one through hole may be arranged close to the same magnetic element. This advantageously allows additional force to be applied close to one or more certain magnetic elements.

In some examples, in addition or alternatively, the through hole is arranged close to an edge of the detachable panel. This advantageously allows the separation member to lift the very edge of the detachable panel. This is particularly advantageous as lifting the detachable panel close to the edge creates a separation at the edge of the panel, into which a maintenance person can insert a tool, or their fingertips, in order to apply a force and thereby separate the detachable panel from the underlying panel. In the case of a panel containing more than one through hole, one, or some, or all of the through holes may be arranged close to the edge.

In the case of a detachable panel comprising more than one through hole, one, some or all of the through holes may be arranged close to the same edge of the detachable panel. Alternatively, a first through hole may be arranged close to a first edge of the panel and a second through hole may be arranged close to a second edge of the panel.

In some examples, in addition or alternatively, the separation member is an expandable member, such that upon engaging with a tool and experiencing the mechanical force, the separation member expands and thus pushes against the back surface of the detachable panel. The separation member could for example be a spring mechanism.

In other examples, the separation member is a screw. This advantageously allows a simple separation mechanism, which can be engaged by a tool through only a small through hole, and can provide a sufficient force. In this case a screwdriver inserted through the through hole can be used to rotate the screw, causing it to unscrew from the elevator car panel and to therefore apply a force to the back surface of the detachable panel, sufficient to create a separation between the detachable panel and the elevator car panel.

In some examples, in addition or alternatively, the head portion of the separation member is substantially flat. This advantageously allows the head portion of the separation member to maintain good contact with the back surface of the detachable panel, in order to apply force to the detachable panel effectively.

In some examples, in addition or alternatively, the elevator panel assembly comprises two separation members and the detachable panel comprises two corresponding through holes for the two separation members. This allows the detachable panel to be separated from the elevator car panel at two separate positions, creating greater separation along the outer edges of the panel and thereby making it easier for a maintenance person to separate the two panels.

In some examples the detachable panel comprises a cut-out. This advantageously allows the detachable panel to be fitted over panels in the elevator car which a passenger still requires access to. For example, the cut-out could be sized so as to allow the detachable panel to be fitted over a car operating panel, optionally the cut-out being sized to match the car operating panel.

According to a further aspect of the present disclosure, there is provided an elevator car panel assembly comprising an elevator panel assembly as described above, and further comprising an elevator car panel covered by the detachable panel, wherein the elevator car panel comprises a ferromagnetic material.

In some examples, in addition or alternatively, the separation member further comprises a body portion and the elevator car panel contains an elevator car panel hole, arranged to receive the body portion of the separation member.

According to another aspect of the present disclosure, there is provided an elevator system comprising an elevator panel assembly, or elevator car panel assembly, as described above and further comprising an elevator car.

DRAWING DESCRIPTION

Certain preferred examples of this disclosure will now be described, by way of example only, and with reference to the accompanying drawings, in which.

DETAILED DESCRIPTION

Figure 1:
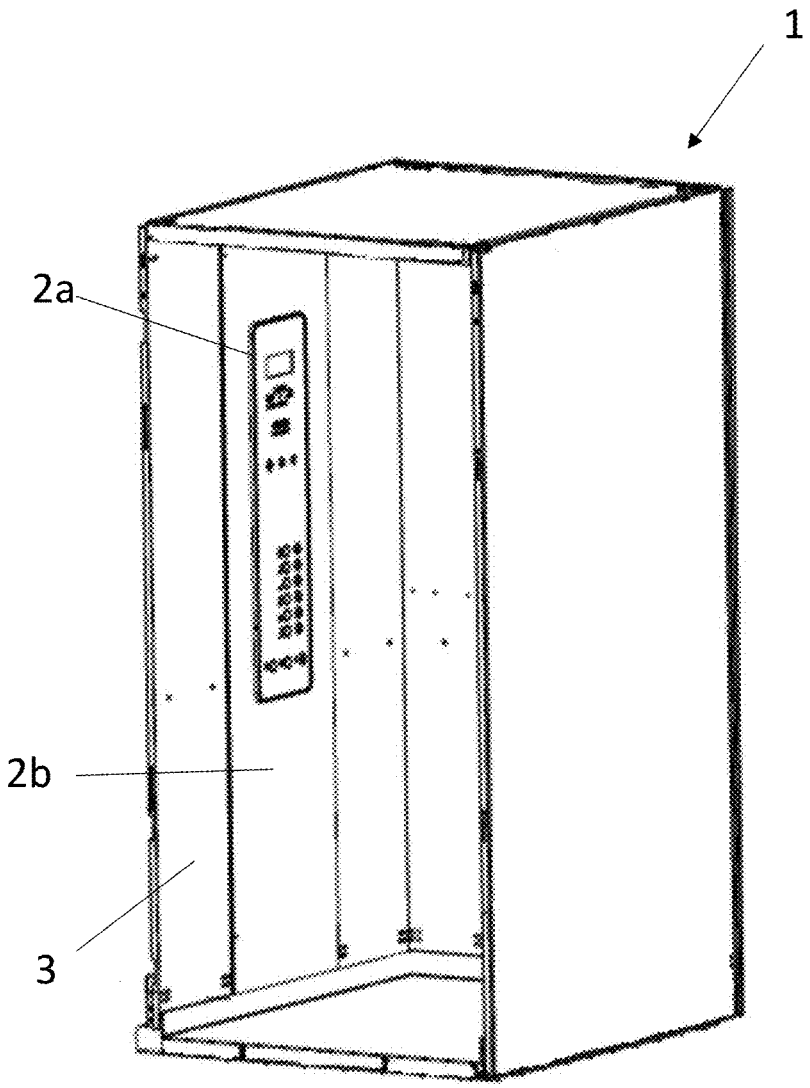
FIG. 1 shows a cut-away view of an elevator car including a car operating panel.

FIG. 1 shows a cut-away view of an elevator car 1 including a car operating panel (COP) 2*a* located in or on an elevator car panel 2*b*, as is visible in the Figure. In many elevator cars it is desirable that a maintenance person can access the various electronics behind the car operating panel 2*a*, as required. In particular the elevator car panel 2*b* on or in which the car operating panel 2*a* is situated can be hinged on one side to allow access. It is often desirable to affix decorative panels, such as decorative panel 3, to the interior walls of an elevator car 1, to improve the appearance of the car interior for a passenger. It is therefore desirable to affix a decorative panel over the elevator car panel 2*b* on which the car operating panel 2*a* is present, which matches the other decorative panels 3 which are affixed to the interior of the elevator car 1. Furthermore, as will be explained in more detail below, it can be desirable for a decorative panel to be attached to and detachable from the elevator car panel 2*b*. Although such panels here are referred to as "decorative" panels, it is to be understood that this term is not intended to be limiting but is simply one example of the function such a panel might fulfil. The description and features described below apply equally to any detachable panel, whether it is also a decorative panel or not. A detachable panel according to the present disclosure could not be decorative or could fulfil a particular function, other than being decorative.

Figure 2:
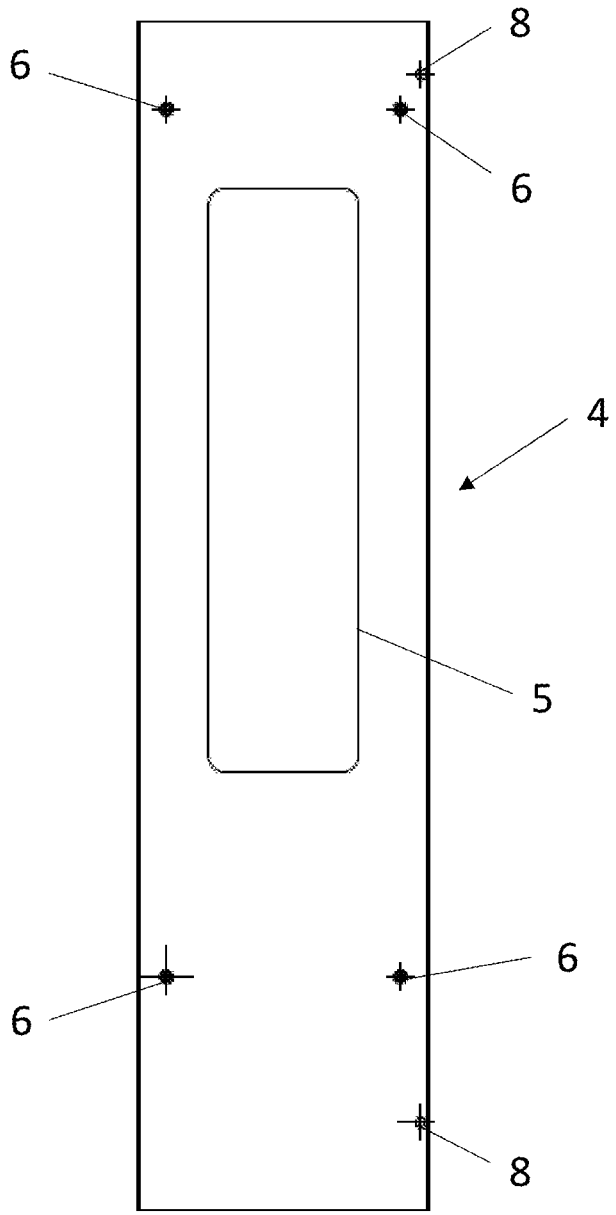
FIG. 2 shows a detachable panel according to the present disclosure.

FIG. 2 shows a detachable panel 4 in the form of a decorative panel suitable to be affixed onto the elevator car panel 2*b*, over the car operating panel 2*a*, as shown in FIG. 1. Although the other decorative panels, such as the decorative panel 3 of FIG. 1, can be formed as a single piece, the detachable panel 4 includes a cut-out portion 5, sized so as to allow the control buttons of the COP 2*a* to protrude through the cut-out 5 and therefore be accessible for use by a user.

Figure 3:
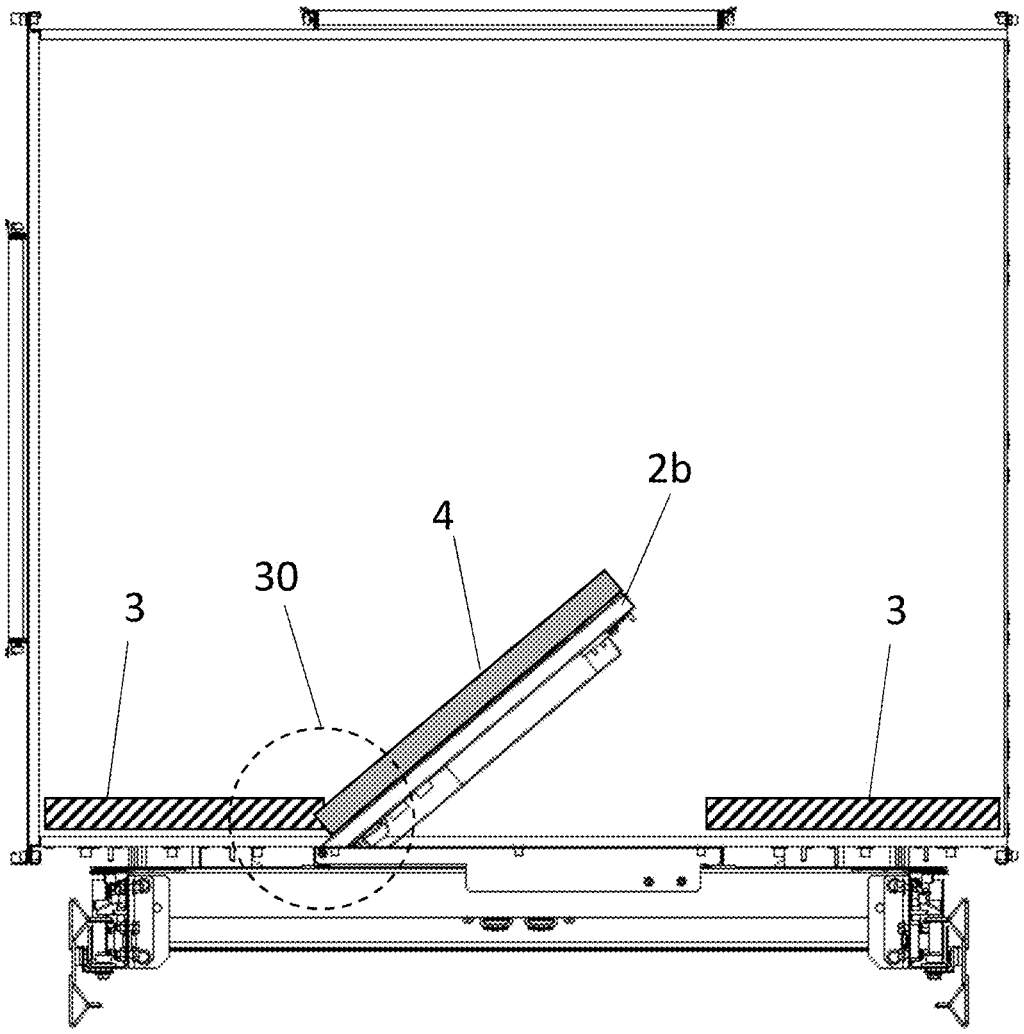
FIG. 3 shows a schematic drawing showing an aerial view of an elevator car interior including decorative panels and a detachable panel according to the present disclosure.

FIG. 3 shows an aerial view of the interior of the elevator car 1 including a car operating panel (not seen) located on or in an elevator car panel 2*b*, which has a detachable panel 4 attached over it. The car wall additionally has decorative panels 3 affixed to it. This view demonstrates an issue that arises with this arrangement of decorative panels, as indicated within the circle 30. The opening of the elevator car panel 2*b* is restricted due to the detachable panel 4 contacting with the adjacent decorative panel 3 at the hinges of the elevator car panel 2*b* which is being opened. Thus it is beneficial for the detachable panel 4 to be detached before opening the elevator car panel 2*b*.

Although this issue is explained in the context of a car operating panel, it is of course equally relevant in the case of any elevator panel which is hinged for opening and on which a decorative panel is to be affixed. The present disclosure presents a solution which allows a decorative panel to be removable from an elevator panel but also to be fixed neatly in position, without any gaps which are unsightly and which would allow anyone to remove the panel and could therefore present a vandalism risk.

In order to resolve this issue, the detachable panel 4 includes one or more magnetic elements 6, as shown in FIG. 2. The elevator car panel 2*b*, on which the car operating panel 2*a* is present, comprises a ferromagnetic material, so that the force of the magnetic elements 6 provides a magnetic attraction force which is sufficiently strong to hold the detachable panel 4 against the elevator car panel 2*b*. The detachable panel 4 is sized to fit exactly over the elevator car panel 2*b*, and to make visible the car operating panel 2*a*, or a section of it, as desired, e.g. through the cut-out 5 (as previously described). In position the detachable panel 4 therefore does not have any gaps around the edges, and sits neatly flush against the car operating panel 2*a* and the adjacent decorative panels 3. A maintenance person is not therefore able to easily insert their hands or a tool behind the detachable panel 4, in order to remove it so that the elevator car panel 2*b* may be opened. This does create a better visual effect to a passenger and reduces the risk of a passenger being able to tamper with the detachable panel 4.

In order to allow the detachable panel 4 to be separated from the elevator car panel 2*b*, a separation member is provided, which could, for example, be a screw. The action of this separation member is described in greater detail with reference to FIGS. 5 and 6.

Figure 4:
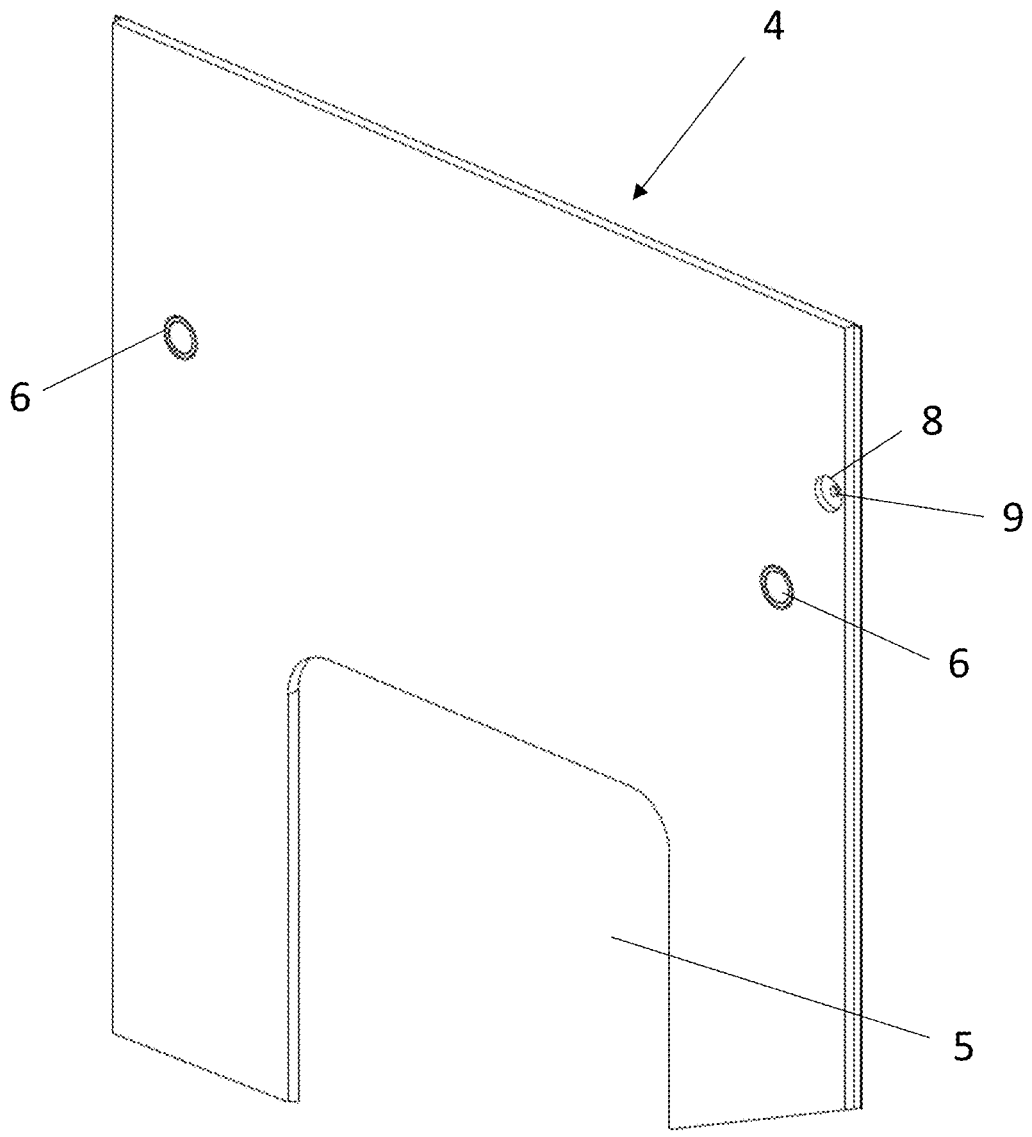
FIG. 4 shows a more detailed view of part of the middle panel of FIG. 3.

FIG. 4 shows a part of the detachable panel 4 of FIG. 2 in more detail. Two of the four magnetic elements 6 are shown, as is the cut-out 5. The detachable panel 4 also includes a recessed portion 8, in which some material of the detachable panel is removed to form a recess which is sized so as to accommodate a separation member. The depth of the recessed portion 8 is smaller than the total thickness of the detachable panel 4, so that the recessed portion 8 is not visible on the outer surface of the detachable panel 4. However, within the recessed portion 8, there is formed a through hole 9. The through hole 9 has a smaller surface area than the recessed portion, and does pass through the whole thickness of the detachable panel 4.

The magnetic elements 6 are arranged towards the corners of the detachable panel 4. The recessed portion 8, and the through hole 9 within the recessed portion 8, are located close to one of the magnets. This provides the advantage that the separation force produced by the separation member is applied close to the magnetic force which is holding the detachable panel 4 against the underlying elevator car panel 2*b*. This allows the force provided by the separation member more effectively separate the detachable panel 4 from the elevator car panel 2*b* of the elevator car.

Moreover, the recessed portion 8 and the through hole 9 are located close to one edge of the detachable panel 4. This allows the separation member, which pushes on the recessed portion 8, to lift the very edge of the detachable panel 4. This is particularly advantageous as lifting the detachable panel 4 close to the edge creates a separation at the edge of the detachable panel 4, into which a maintenance person can insert a tool, or their fingertips, in order to apply a force and thereby separate the detachable panel 4 from the elevator car panel 2*b*.

Figure 5:
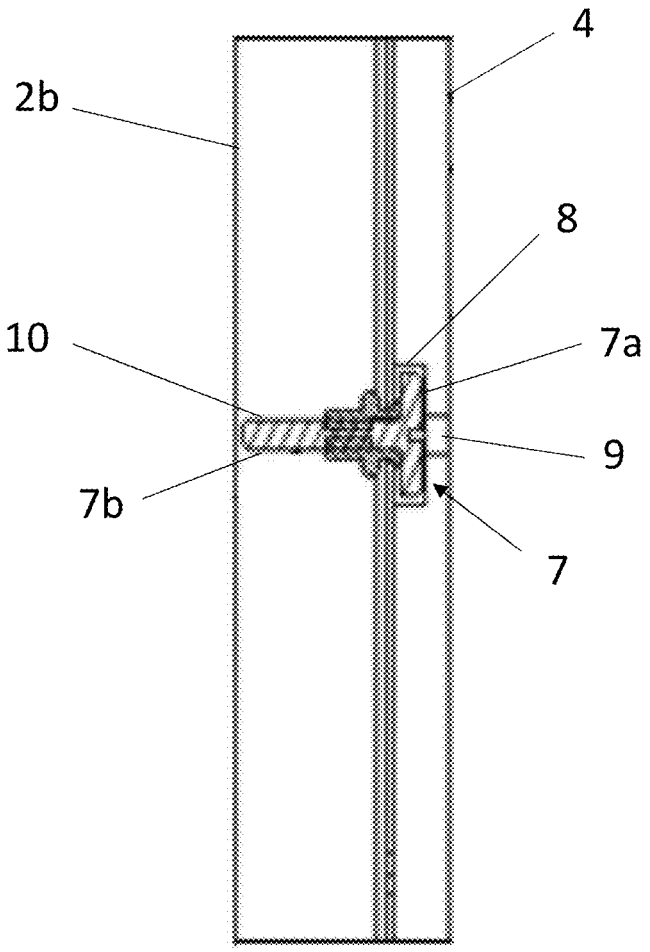
FIG. 5 shows a cross-section of an elevator panel and a detachable panel, positioned flush against each other, with a separating member positioned between the panels.

FIG. 5 shows a cross-sectional view of the detachable panel 4, held in position by magnets (not shown) against the elevator car panel 2*b*. The separation member comprises a head portion 7*a*, which fits neatly into the recessed portion 8, allowing the detachable panel 4 to sit closely flush against the elevator car panel 2*b* of the elevator car.

The separation member 7 additionally comprises a body portion 7*b*. If the separation member 7 is a screw, the body portion 7*b* comprises the screw thread. The body portion 7*b* of the separation member 7 is inserted into a second hole, referred to as the elevator car panel hole 10 formed in the elevator car panel 2*b* of the elevator car.

Figure 6:
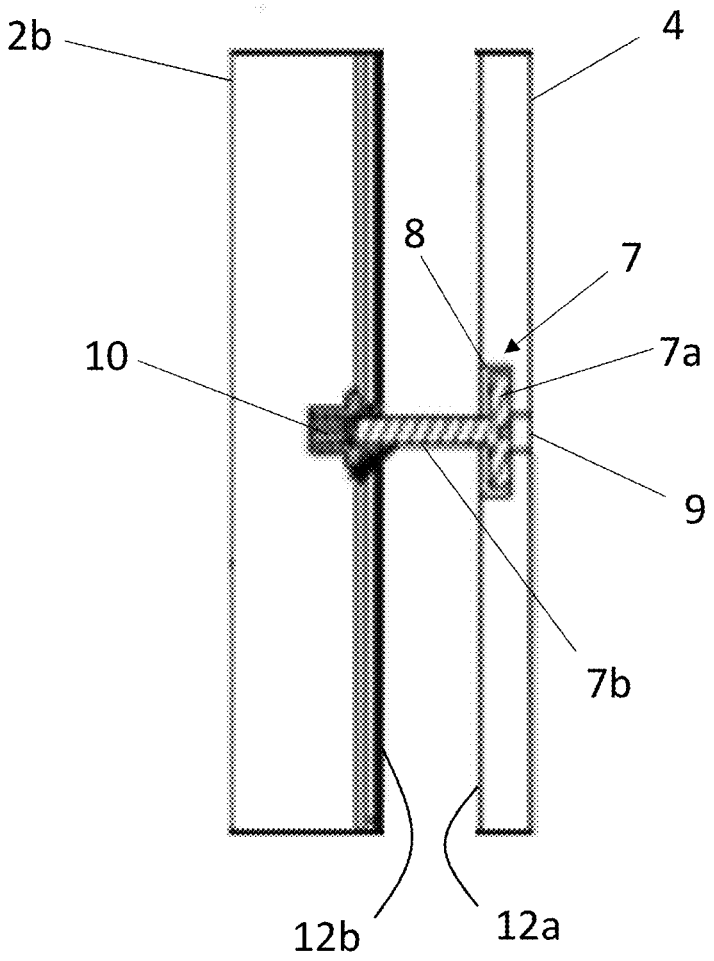
FIG. 6 shows a cross-section of an elevator panel and a detachable panel, after they have been separated by a separating member.

FIG. 6 shows the detachable panel 4 after its back surface 12*a* has been separated from a front surface 12*b* of the elevator car panel 2*b* of the elevator car by the action of the separation member 7. In order to separate the panels, a screwdriver, or similar appropriate tool, is inserted through the through hole 9 in the detachable panel 4. Through this through hole 9, the tool can access the head portion 7*a* of the separation member 7. In some examples the separation member 7 is a screw. In this case a screwdriver can be used to engage with the screw 7. The screwdriver is inserted into the thread on the head of the screw 7, and the screwdriver is turned in the appropriate direction, causing the separation member 7 to move in a direction out of the elevator car panel 2*b*, such that the body portion 7*a* is partially, or fully, removed from the elevator car panel hole 10, present in the elevator car panel 2*b*. In other examples, the separation member 7 is an expandable member 7 which is engaged by an appropriate tool, so as to apply a force against the back surface of the detachable panel 4. In this case a tool other than a screwdriver could be used. For example the separation member 7 could be a latched spring and a small tool, for example a pin, could be inserted through the through hole 9 and used to disengage a latch, causing the spring to expand, and push on the detachable panel 4.

When a tool engages with the separation member 7, this causes the head portion 7*a* of the separation member 7 to push on the detachable panel 4, specifically on the recessed portion 8 in which the head portion 7*a* is located, pushing the panels apart and creating a separation between them. It is then possible for a maintenance person to insert an appropriate tool between the detachable panel 4 and the adjacent panels 3, and to apply sufficient force to overcome the magnetic attraction of the magnets to the elevator car panel 2*b*, and to separate the detachable panel 4 from the elevator car panel 2*b*. The tool can be any suitable tool able to separate the detachable panel 4 from the elevator car panel 2*b*. It could for example be a screwdriver, or a crowbar, or alternatively a maintenance person could insert their fingertips into the separation and apply the separation force manually. The maintenance person is thus able to remove the detachable panel 4 from the elevator car panel 2*b*, and is then able to freely open the elevator car panel 2*b* as required, without the detachable panel 4 causing any restriction.

It will be appreciated by those skilled in the art that the disclosure has been illustrated by describing one or more specific aspects thereof, but is not limited to these aspects; many variations and modifications are possible, within the scope of the accompanying claims.

What is claimed is:

1. An elevator panel assembly, comprising:

a detachable panel (4) for covering a front surface (12*b*) of an elevator car panel (2*b*), wherein the detachable panel (4) is magnetically attachable to the elevator car panel (2*b*);

a separation member (7) comprising a head portion (7*a*) received against a back surface (12*a*) of the detachable panel (4);

wherein the detachable panel (4) comprises a through hole (9) which is smaller than the head portion (7*a*) of the separation member (7) and arranged to sit directly over the head portion (7*a*); and wherein the separation member (7) is configured so that a tool inserted through the through hole (9) engages with the head portion (7*a*) to apply a mechanical force, causing the head portion (7*a*) to push against the back surface of the detachable panel (4).

2. The elevator panel assembly of claim 1, wherein the back surface of the detachable panel (4) further comprises a recessed portion (8), surrounding the through hole (9) and sized to contain the head portion (7*a*) of the separation member (7).

3. The elevator panel assembly of claim 1, wherein the detachable panel (4) comprises at least one magnetic element permanently attached to the back surface (12*a*) of the detachable panel (4).

4. The elevator panel assembly of claim 3, wherein the detachable panel (4) comprises four magnetic elements, arranged towards four corners of the back surface of the detachable panel (4).

5. The elevator panel assembly of claim 3, wherein the through hole (9) is arranged close to the at least one magnetic element.

6. The elevator panel assembly of claim 1, wherein the through hole (9) is arranged close to an edge of the detachable panel (4).

7. The elevator panel assembly of claim 1, wherein the separation member (7) is a screw.

8. The elevator panel assembly of claim 1, wherein the head portion (7*a*) of the separation member (7) is substantially flat.

9. The elevator panel assembly of claim 1, comprising two separation members (7), wherein the detachable panel (4) comprises two corresponding through holes (9) for the two separation members (7).

10. The elevator panel assembly of claim 1, wherein the detachable panel (4) comprises a cut-out (5).

11. An elevator car panel assembly comprising an elevator panel assembly as claimed in claim 1, and further comprising an elevator car panel (2*b*) covered by the detachable panel (4), wherein the elevator car panel (2*b*) comprises a ferromagnetic material.

12. The elevator car panel assembly of claim 11, wherein the separation member (7) further comprises a body portion (7*b*) and wherein the elevator car panel (2*b*) contains an elevator car panel hole (10) arranged to receive the body portion (7*b*) of the separation member (7).

13. An elevator system comprising an elevator panel assembly as claimed in claim 1 and an elevator car.

14. A method of detaching a detachable panel (4) from a front surface (12*b*) of an elevator car panel (2*b*) to which a back surface (12*a*) of the detachable panel (4) is magnetically attached, wherein a separation member (7) comprising a head portion (7*a*) is received against the back surface (12*a*) of the detachable panel (4) and the detachable panel (4) comprises a through hole (9) which is smaller than the head portion (7*a*) of the separation member (7) and arranged to sit directly over the head portion (7*a*), the method comprising:

inserting a tool through the through hole (9) in the detachable panel (4); and engaging the tool with the head portion (7*a*) of the separation member (7) to apply a mechanical force, causing the head portion (7*a*) to push against the back surface (12*a*) of the detachable panel (4) and thereby create a separation from the front surface (12*b*) of the elevator car panel (2*b*).

15. The method of claim 14, further comprising:

using the separation to apply a force sufficient to overcome the magnetic attraction between the elevator car panel (2*b*) and the detachable panel (4); and removing the detachable panel (4).

* * * * *